US005106328A

United States Patent [19]

Prochaska et al.

[11] Patent Number: 5,106,328

[45] Date of Patent: Apr. 21, 1992

[54] CONTACT PIN AND BUSHING ASSEMBLY

[75] Inventors: Walter Prochaska; Paul-Rainer Molitor, both of Mühldorf, Fed. Rep. of Germany

[73] Assignee: Otto Dunkel GmbH Fabrik fur Elektrotechnische Gerate, Muhldorf, Fed. Rep. of Germany

[21] Appl. No.: 739,292

[22] Filed: Aug. 1, 1991

[30] Foreign Application Priority Data

Aug. 1, 1990 [DE] Fed. Rep. of Germany ..... 4024456

[51] Int. Cl.[5] ..... H01R 13/41

[52] U.S. Cl. ..... 439/751; 439/81; 439/84

[58] Field of Search ..... 439/81, 82, 84, 751, 439/873

[56] References Cited

U.S. PATENT DOCUMENTS 4,526,429 7/1985 Kirkman ..... 439/751 X
4,596,437 6/1986 Rush ..... 439/751 X
4,720,268 1/1988 Weiss ..... 439/751 X

FOREIGN PATENT DOCUMENTS 3915644 11/1990 Fed. Rep. of Germany .

*Primary Examiner*—Eugene F. Desmond
*Attorney, Agent, or Firm*—Fleit, Jacobson, Cohn, Price, Holman & Stern

[57] ABSTRACT

A contact pin and bushing assembly has the contact pin and a pin support, which limits the degree of insertion of the contact pin into an aperture in a circuit board, formed as separate items which are clamped together by the back end of the pin being pressed into a bore in the support. The pin support is provided at the base of the contact bushing.

6 Claims, 1 Drawing Sheet

CONTACT PIN AND BUSHING ASSEMBLY

BACKGROUND OF THE INVENTION

This invention relates to a contact pin and bushing assembly in which the contact pin has two approximately parallel legs for insertion into an aperture in a circuit board, which legs border an elongated hole created by stamping and have a spring action one relative to the other, wherein a shoulder of a support part of the assembly serves to limit the degree of insertion into said aperture; and in which the contact spring bushing comprises a plurality of contact springs disposed at a distance from the bushing axis, and extending lengthwise approximately from the area of the support part shoulder to the area of a plug pin insert hole, the shortest distance from the bushing axis being roughly in the center of the bushing.

In a known contact pin and bushing assembly of this type, as disclosed in Germany patent application No. P 39 15 644.3, the contact pin is configured as a single-piece component. This is initially produced as turned part, comprising the shoulder and a contact pin section projecting from said shoulder, from which the elongated hole is stamped after extraneous material on either side has been machined away and the part has been given a flat shape. As an alternative, it is possible to proceed from strip material of contact sheet metal, with two strip areas of differing thickness, specifically an area with a width matching the diameter of the shoulder and an area with a width matching that of the desired contact pin. A blank is stamped out of this material while simultaneously forming the elongated hole; the shoulder is then formed from the blank in a turning procedure. Both means of production are relatively involved and cost-intensive.

SUMMARY OF THE INVENTION

It has been found that contact pin-contact spring bushing components of the above type can be produced in a considerably simpler fashion than heretofore, and with results of excellent quality, when, in accordance with the invention, the contact pin is formed as a stamped part independently of the support part with the shoulder serving to limit the amount of insertion of the pin, and with said contact pin then being connected with the support part by means of a clamp or press-fit connection. It is expedient to provide the support part with a clamping hole which is exposed on the side facing away from the contact spring bushing so that the contact pin can be inserted into this hole with its back end.

A particularly simple embodiment results when the back end of the contact pin has a rectangular, and preferably a square, cross-section and the distance between the diametrically opposite pin edges is adjusted to conform with the diameter of the clamping hole.

A connection of improved quality based on the spring action of the pin during insertion will result if two facing sides of the pin end are arched in axially parallel fashion relative to the axis of the pin. This feature permits the outer edge areas to yield elastically in the direction of the arch curvature when the pin is inserted.

It is considered advantageous, both with regard to technical production and to the quality of the connection, if the pin end, in a manner analogous to the contact pin, displays two approximately parallel snap-in legs for insertion into the clamping hole, which together border an elongated snap-in hole formed through stamping, each of which yields elastically in the direction of the other.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 5:
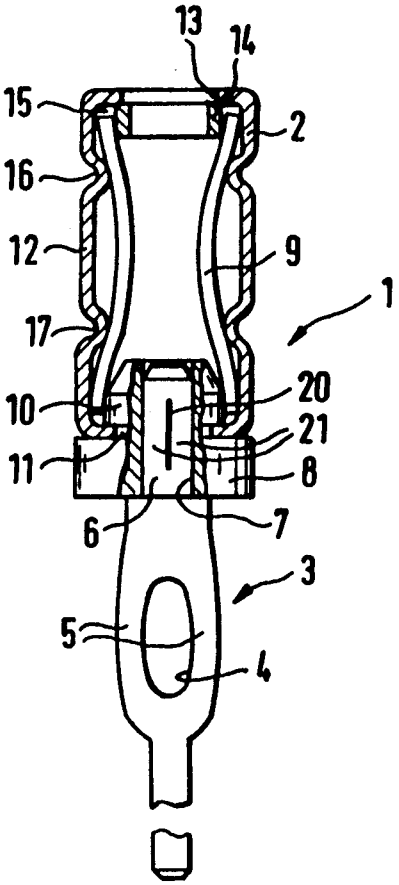
FIG. 5 is a side view of the contact pin and bushing assembly on a larger scale and partially in section, with a contact pin as shown in FIG. 4.

In describing a preferred embodiment of the invention illustrated in the drawings, specific terminology will be resorted to for the sake in clarity. However, the invention is not intended to be limited to the specific terms so selected, and it is to be understood that each specific term includes all technical equivalents which operate in a similar manner to accomplish a similar purpose.

Figure 1:
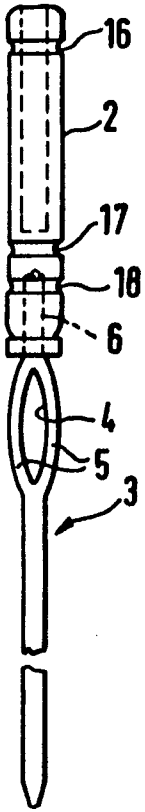
FIG. 1 is a schematic elevational view of a contact pin and bushing assembly according to the invention.

FIGS. 1 and 5 show a contact bushing and pin assembly 1 with a contact spring bushing 2 for the secure transmission of current to or from a plug pin (not shown in the diagram) inserted into the bushing to a contact pin 3 which is mechanically and elastically connected to the bushing. For the attachment of the contact pin and bushing assembly 1 in an aperture of an electrical circuit board (not shown), the flatly configured contact pin 3 facing away from the insert end of the plug pin is provided with two approximately parallel legs 5 which give elastically in the direction one to the other and which border an elongated hole 4 formed by stamping. The legs 5 terminate with the pin end 6, which is provided with a shoulder 8 forming part of the contact spring bushing 2 and serving to limit the insertion depth of pin 3. Specifically, pin end 6 is clamped or gripped in a central clamping hole 7 in a support part 8 defining the shoulder. As can be seen in the given embodiment, contact springs 9 inserted into the bushing rest with their back end on a cylindrical neck 10 which projects from the shoulder and displays a circular groove 11 at its foot. Engaging with this circular groove 11 is the beaded rim of a bushing body 12 of the contact spring bushing 2, the bushing body 12 having the form of a thin-walled elastic jacket. Here the rim, with frontal contact with the shoulder, presses together the contact springs 9 located between it and the annular neck 10.

Within the spark protection rim, which is formed by a flanged area and which displays a central pin insertion hole 13, an annular body 14 rests against the flange; its inner diameter is somewhat smaller than the pin insertion hole 13 provided in the bushing body 12. The contact springs 9 distributed around the inner circumference and secured in the area of the shoulder are guided freely at their loose end in an annular gap 15 between the bushing body 12 and the annular body 14.

The arch, directed radially inward, in contact springs 9, as shown in FIG. 5, is created by providing the bushing body 12 from the outside with a circular bead 16 and 17, each projecting radially inward, at two points axially displaced relative to the annular body 14 or the circular neck 10; the circular bead rests against the contact springs 9 and elastically deforms them radially and inwardly. In the area surrounding each circular bead 16 and 17 the bushing body 12 is given an inner diameter that is smaller than the outer diameter of the annular body 14 supporting the unattached ends of the contact springs 6, increased by twice the diameter of the contact springs 9.

In the contact bushing and pin assembly shown in simplified form in FIG. 1, an additional radial indentation 18 is provided as compared with the embodiment shown in greater detail in FIG. 5, in order to firmly press the contact springs (not shown) within the contact spring bushing 2 against the annular neck 10 (also not shown).

Figure 2:
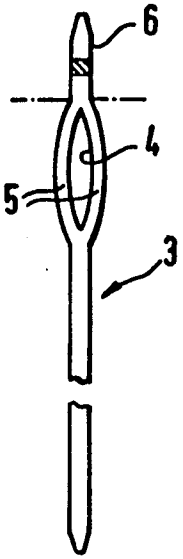
FIG. 2 is a side view of a first embodiment contact pin.

FIG. 2 depicts the simplest form for the back end 6 of the contact pin 3. Here, the pin end 6 has rectangular, preferably square, section, and the distance between the diametrically opposite pin edges is adjusted to conform to the diameter of the clamping hole 7. With a slight enlargement of the diagonal spacing distance of the pin edges, the pin edges will engage with the wall of the clamping hole 7 of the contact spring bushing 2 with a force fit when the contact pin 3 is connected by means of the pin end 6. Secure positioning and contact are assured in this matter.

Figure 3:
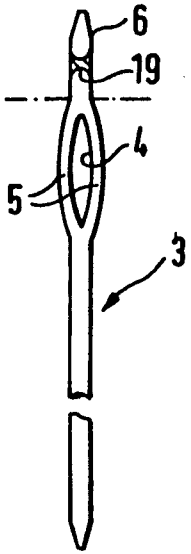
FIG. 3 is a side view of a second embodiment contact pin.

The embodiment according to FIG. 3 depicts an improved sectional form of the pin end 6. As the diagram suggests, two opposite sides of the pin end 6 are provided with an arch 19 of more or less axially parallel shape, relative to the pin axis. As the result the outer rim areas of the pin end 6 are elastically deformable in the direction of the axis of curvature of the vault 19 upon insertion.

Figure 4:
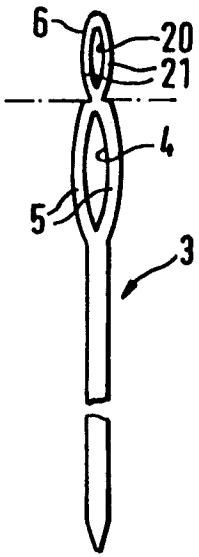
FIG. 4 is a side view of a third embodiment contact pin.

In the embodiment according to FIGS. 4 and 5, a qualitative improvement of the connection between the contact pin 3 and the contact bushing 2 is assured as the result of elastic deformation during insertion. As can be seen, the pin end 6, analogous to the actual contact pin 3, is provided with a stamped-out area by means of which two clamping legs 21 are formed bordering an elongated clamping hole, in order to thereby provide the legs with a spring action, one in the direction of the other, upon insertion into the clamping hole 7.

Having described the invention, many modifications thereto will become apparent to those skilled in the art to which it pertains without deviation from the spirit of the invention as defined by the scope of the appended claims.

We claim:

1. A contact pin and bushing assembly comprising a contact pin having two approximately parallel legs for insertion into an aperture in a circuit board, which legs define an elongated hole therebetween and have a spring action one relative to the other, a support part having a shoulder for limiting the depth of insertion of the pin into said aperture, a contact spring bushing including a plurality of contact springs spaced from a longitudinal bushing axis and extending lengthwise from said support part to adjacent a plug pin insertion hole at one end of the bushing remote from the contact pin, wherein the contact pin is a stamped part independent of the support part and is connected to the support part by a clamped connection.

2. An assembly as defined in claim wherein the support part is provided with a clamping hole in which a back end of the contact pin is inserted to form the clamped connection.

3. An assembly as defined in claim 2, wherein the back end of the contact pin is rectangular in shape and the distance separating diametrically opposite edges thereof is adjusted to conform to the diameter of the clamping hole.

4. An assembly as defined in claim 3, wherein the back end of the contact pin is square in shape.

5. An assembly as defined in claim 3, wherein two opposing sides of the pin are provided with an arch which runs in the direction of the pin axis in approximately parallel fashion.

6. An assembly as defined in claim 2, wherein the back end of the contact pin has two clamping legs bordering an elongated clamping hole formed by stamping, the clamping legs being inserted into the clamping hole and having a spring action one relative to the other.

* * * * *